US005232356A

United States Patent [19]

Takeda et al.

[11] Patent Number: 5,232,356

[45] Date of Patent: Aug. 3, 1993

[54] SEAL DEVICE FOR GEAR PUMP

[75] Inventors: Masahiro Takeda; Hiroyuki Fukui, both of Atsugi, Japan

[73] Assignees: Kabushiki Kaisha Komatsu Seisakusho; Komatsu Zenoah Kabushiki Kaisha, both of Tokyo, Japan

[21] Appl. No.: 920,373

[22] PCT Filed: Feb. 12, 1991

[86] PCT No.: PCT/JP91/00164

§ 371 Date: Aug. 7, 1992

§ 102(e) Date: Aug. 7, 1992

[87] PCT Pub. No.: WO91/12431

PCT Pub. Date: Aug. 22, 1991

[30] Foreign Application Priority Data

Feb. 16, 1990 [JP] Japan ..... 2-13705[U]

[51] Int. Cl.[5] ..... F01C 19/08

[52] U.S. Cl. ..... 418/132

[58] Field of Search ..... 418/131, 132

[56] References Cited

U.S. PATENT DOCUMENTS 3,482,524 12/1969 Marietta ..... 418/132

3,891,360 6/1975 Dworak et al. ..... 418/132

3,895,890 7/1975 Laumont ..... 418/132

FOREIGN PATENT DOCUMENTS 56-35582 8/1954 Japan .

56-35583 8/1954 Japan .

56-77588 6/1981 Japan .

59-131788 7/1984 Japan .

*Primary Examiner*—Richard A. Bertsch

*Assistant Examiner*—Charles Freay

*Attorney, Agent, or Firm*—Flynn, Thiel, Boutell & Tanis

[57] ABSTRACT

A seal device for a gear pump, whose gear case (1), rotatably containing a pair of gears (2), (3) meshing with each other therein, is closed by side plates (4) at both sides thereof interposing seals (5) therebetween, wherein the seal (5) is formed of a plurality of annular parts ($5_1$), ($5_2$), projections 5*a*) formed on the annular parts ($5_1$), ($5_2$), a connecting part (5*c*) for connecting the annular parts ($5_1$), ($5_2$), and a notch (5*d*) formed on at least one side of said connecting part (5*c*). Thanks to a structure as above, even when a tensile force acts on the connecting part during the use of the device, cracks concentratedly develop at the notch (5*d*) and are prevented from developing at the other parts, whereby oil leakage can be prevented.

1 Claim, 6 Drawing Sheets

SEAL DEVICE FOR GEAR PUMP

TECHNICAL FIELD

The present invention relates to a seal device for a gear pump.

BACKGROUND TECHNOLOGY

In a conventional gear pump as illustrated in FIG. 6, a pair of gears 2 and 3 meshing with each other are rotatably contained in a gear case 1 which is closed by side plates 4 at both sides thereof.

As illustrated in FIG. 7, seals 5 are disposed between the case 1 and the side plates 4 for preventing oil leakage and for providing a pressure balancing high pressure chamber in the gear case 1.

Each of the seals 5 has a shape as illustrated in FIG. 8 and cross sectional shapes as illustrated in FIGS. 9(*a*), 9(*b*), 9(*c*) and 9(*d*) respectively. The seals comprise projections 5*a* made of rubber and projections 5*b* formed by injection molding of fluorocarbon resin.

In the conventional seal device for the gear pump, there is a possibility of generating a crack a at the connecting part 5*c* of projections 5*a* when a tensile force acts on the connecting part 5*c* shown in FIG. 9(*d*) if an inner pressure is applied to the seal 5.

No oil leakage occurs at the crack a in the connecting part 5*c*. However, if the crack a develops to thereby generate new cracks b at the projections 5*a*, there is a likelihood of oil leakage at the cracks b.

Accordingly, the present invention has been made to solve the drawbacks set forth above and to provide a seal device for a gear pump capable of generating cracks concentratedly at the connecting part of projections to thereby prevent oil leakage.

DISCLOSURE OF THE INVENTION

It is an object of the present invention to achieve the above object and to provide a seal device for a gear pump, and, in the gear pump whose gear case rotatably containing a pair of gears meshing with each other is closed by side plates at both sides thereof interposing seals therebetween, said seal is formed of a plurality of annular parts, projections formed on the annular parts, a connecting part for connecting the projections at the portions where the same are close to each other, and a notch formed on at least one side of said connecting part, whereby even when a tensile force acts on the connecting part during the use of the device, a crack concentratedly develops at the notch and is prevented from developing at the other parts, whereby oil leakage can be prevented.

BEST MODE FOR CARRYING OUT THE INVENTION

An embodiment of the present invention will be described with reference to FIGS. 1 to 5.

Since a gear pump body is the same as the conventional one, it is denoted at the same numerals and described hereinafter.

The seal 5 interposed between the gear case 1 and the side plates 4 comprises the projections 5*a* made of an elastic material such as rubber and projections 5*b* formed by injection molding of fluorocarbon resin.

The projections 5*a* comprises annular parts $5_1$ for sealing a peripheral portion of a gear chamber 1*a* housing gears 2 and 3 therein and the side plates 4 and annular parts $5_2$ disposed inside the annular parts $5_1$ for sealing peripheries of the shaft portions 2*a* and 3*a* of the gears 2 and 3 and a pressure balancing high pressure chamber 4*a*. The projections 5*b* of fluorocarbon resin is provided at the entire periphery inside the annular parts $5_2$.

Figure 1:
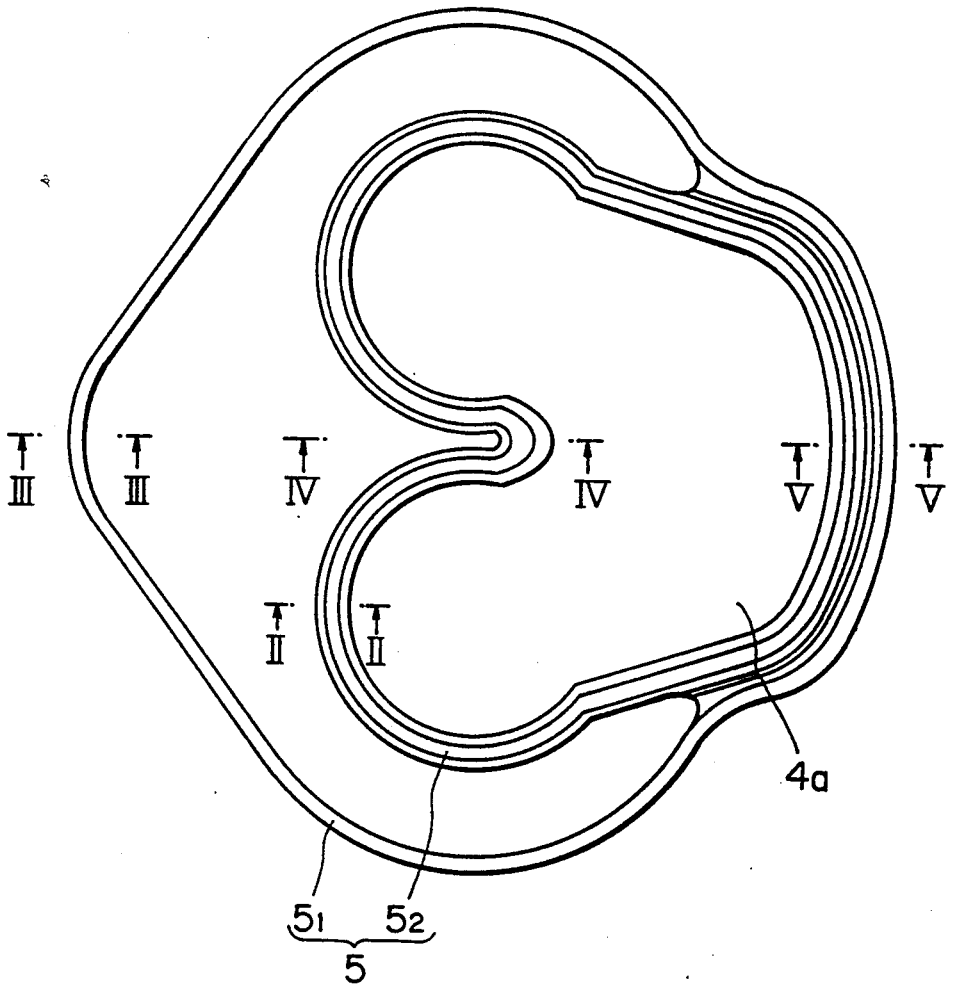
FIG. 1 is a plan view of a seal according to an embodiment of the present invention.
Figure 2:
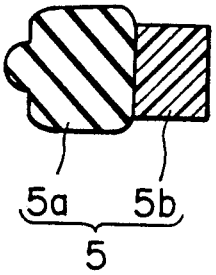
FIG. 2 is a cross-sectional view taken along II—II of FIG. 1.
Figure 3:
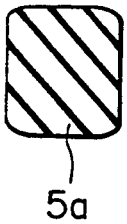
FIG. 3 is a cross-sectional view taken along II—III of FIG. 1.
Figure 4:
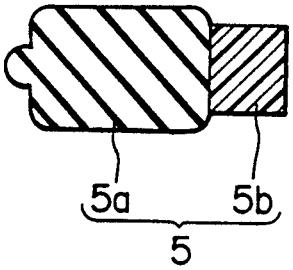
FIG. 4 is a cross-sectional view taken along IV—IV of FIG. 1.
Figure 5:
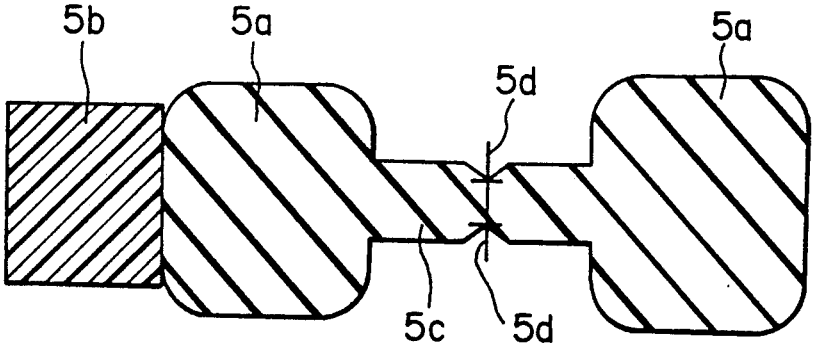
FIG. 5 (PRIOR ART)
FIG. 5 is a cross-sectional view taken along V—V of FIG. 1.
Figure 6:
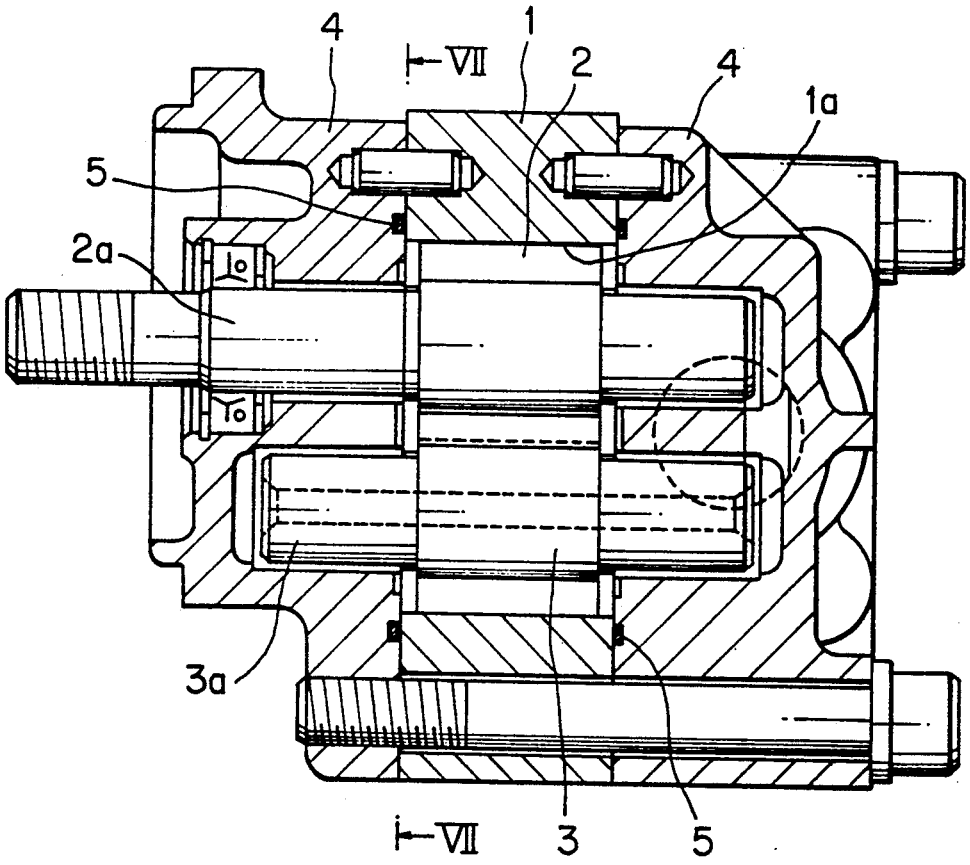
FIG. 6 (PRIOR ART)
FIG. 6 is a cross-sectional view of a gear pump.
Figure 7:
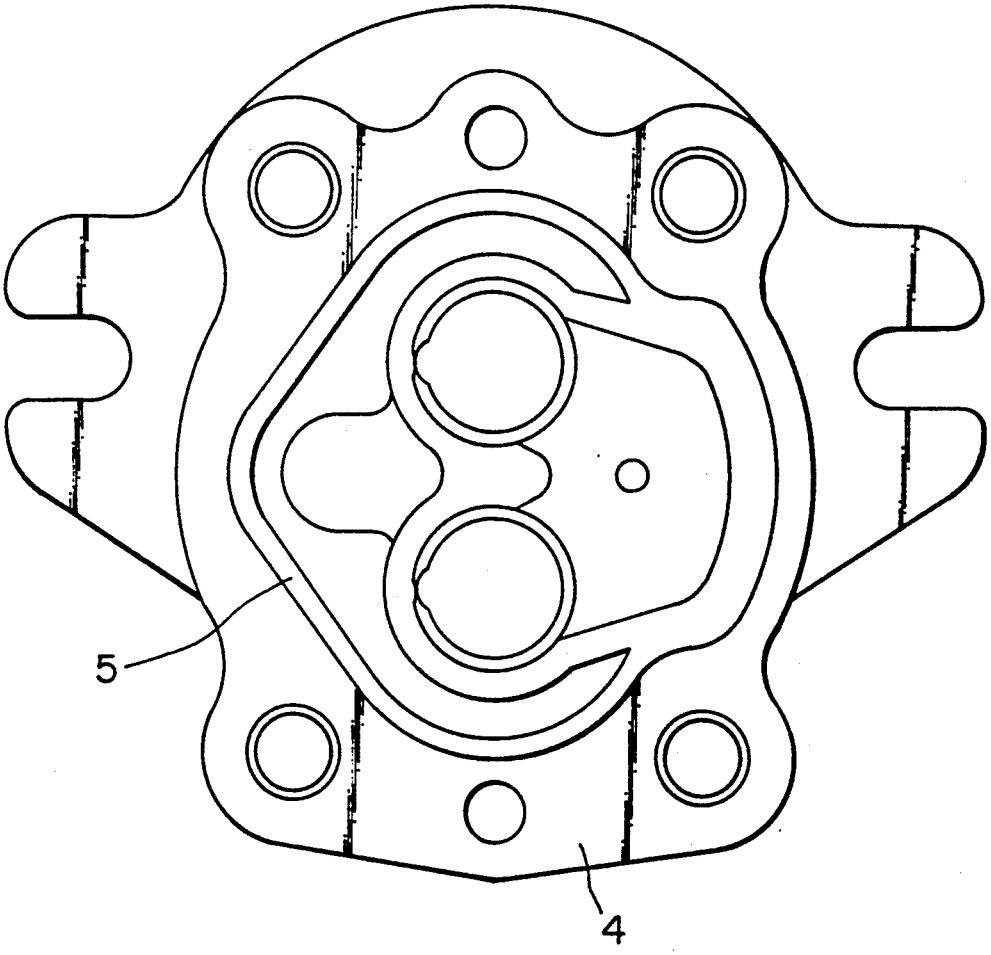
FIG. 7 is a cross-sectional view taken along VII—VII of FIG. 6.
Figure 8:
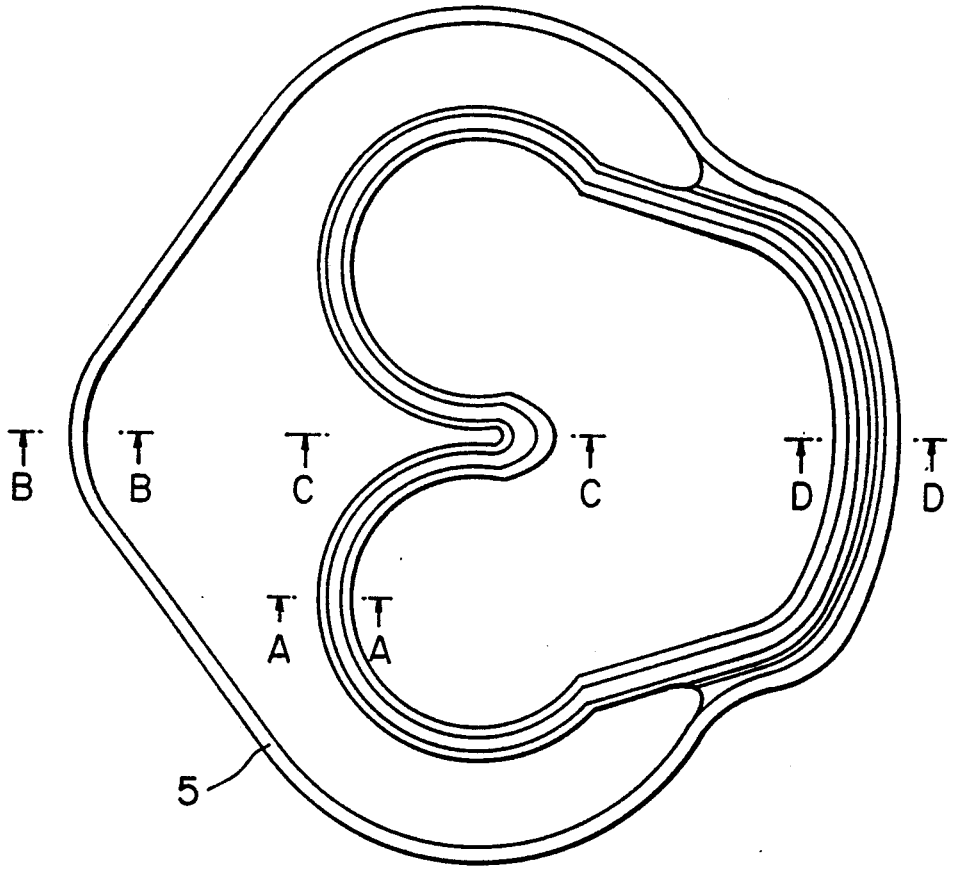
FIG. 8 ( PRIOR ART)
FIG. 8 is a plan view of a conventional seal, FIG. 9(*a*) is a cross-sectional view taken along A—A of FIG. 8, FIG. 9(*b*) is a cross-sectional view taken along B—B of FIG. 8, FIG. 9(*c*) is a cross-sectional view taken along C—C of FIG. 8, and FIG. 9(*d*) is a cross-sectional view taken along D—D of FIG. 8.
Figure 9A:
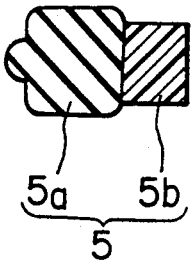
FIG.9(a) (PRIOR ART)
Figure 9B:
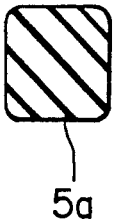
FIG.9(b) (PRIOR ART)
Figure 9C:
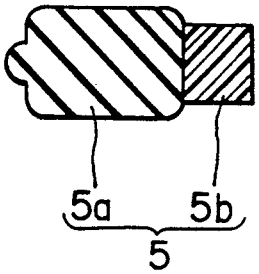
FIG.9(c) (PRIOR ART)
Figure 9D:
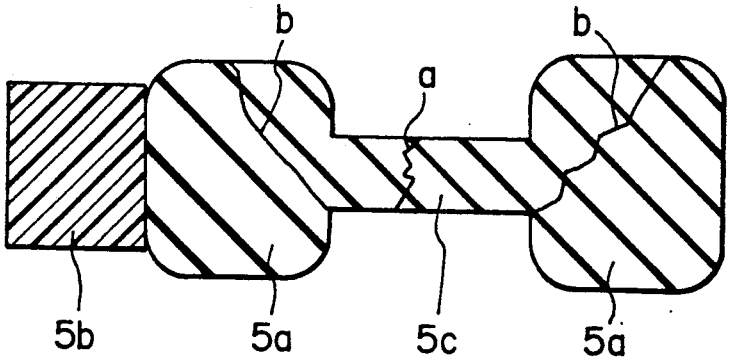
FIG.9(d) (PRIOR ART)

The projections 5*a* are close to each other at the part of the annular parts $5_1$ and $5_2$ and are connected to each other by a connecting part 5*c* as illustrated in FIG. 5. V-shaped notches 5*d* are formed on both sides of the central portion of the connecting part 5*c*.

Cross sections of the seal 5 at several parts thereof are illustrated in FIGS. 2 to 5. The V-shaped notch 5*d* may be provided on one side alone of the central portion of the connecting part 5*c*.

INDUSTRIAL UTILIZATION

In the present invention set forth above, inasmuch as cracks concentratedly generate at the notch but not generate at the projections even if a tensile force acts on the connecting part during the use of the seal device interposed between the gear case and the side plates, it is possible to prevent the quick reduction of seal effect due to cracks and to prevent the generation of oil leakage.

It is possible to provide the seal device with an economical price almost as low as that of a conventional one by merely providing the notch previously at the seal.

We claim:

1. In a seal device for a gear pump whose gear case, rotatably containing a pair of gears meshing with each other, is closed by side plates at both sides thereof interposing seals therebetween, said seal is formed of a plurality of annular parts, projections formed on the annular parts, a connecting part for connecting the annular part at the portions where the annular parts are close to each other, and a notch formed on at least one side of said connecting part.

* * * * *